United States Patent [19]

Hynes et al.

[11] Patent Number: 4,476,935

[45] Date of Patent: Oct. 16, 1984

[54] SAFETY VALVE APPARATUS AND METHOD

[75] Inventors: Joseph H. Hynes, Houston; Charles D. Morrill, Humble, both of Tex.

[73] Assignee: Hydril Company, Los Angeles, Calif.

[21] Appl. No.: 473,564

[22] Filed: Mar. 9, 1983

[51] Int. Cl.[3] ..... E21B 29/00

[52] U.S. Cl. ..... 166/373; 166/55; 166/317; 166/383; 166/298; 137/68 R; 251/1 R

[58] Field of Search ..... 166/55, 97, 316, 317, 166/323, 297, 363, 364, 373, 376, 379, 382, 383; 137/68 R; 251/1 A, 1 R; 285/325, 326, 327, 67; 138/155

[56] References Cited

U.S. PATENT DOCUMENTS

| | | | |
|---|---|---|---|
| 1,851,894 | 3/1932 | Clough . | |
| 2,919,111 | 12/1959 | Nicolson | 255/1.8 |
| 2,969,838 | 1/1961 | Wilde | 166/55 |
| 3,125,108 | 3/1964 | Murphy | 137/68 R |
| 3,379,255 | 4/1968 | Burns, Jr. et al. | 166/55 |
| 3,532,113 | 10/1970 | McKean | 137/318 |
| 3,561,526 | 2/1971 | Williams, Jr. et al. | 166/55 |
| 3,590,920 | 7/1971 | Orund | 166/55 |
| 3,716,068 | 2/1973 | Addidson | 137/67 |
| 3,720,260 | 3/1973 | Duck et al. | 166/364 |
| 3,736,982 | 6/1973 | Vujasinovic | 251/1 |
| 3,766,979 | 10/1973 | Petrick | 166/55 |
| 3,817,326 | 6/1974 | Meynier | 251/1 |
| 4,132,265 | 1/1979 | Williams, Jr. | 166/55 |
| 4,132,267 | 1/1979 | Jones | 166/55 |
| 4,347,898 | 9/1982 | Jones | 166/55 |

OTHER PUBLICATIONS

"Shear Rams For Blowout Preventers" by Vujasinovic, The American Society of Mechanical Engineering, 1975.

*Primary Examiner*—Stephen J. Novosad
*Assistant Examiner*—William P. Neuder
*Attorney, Agent, or Firm*—Dodge & Bush

[57] ABSTRACT

A safety valve for controlling flow in a flow line is disclosed which is especially adapted for use in emergency control of a producing well. The apparatus includes means for securing a punch out tube in series with the flow line and ramming means for ramming the punch out tube and displacing at least a portion of it from the flow path of the flow line and sealing the flow line. The punch out tube comprises top, bottom and middle cylindrical members stacked end to end with an elastomeric seal provided in channels resulting from cooperating grooves formed in the end surfaces of the members. When the middle member is rammed, while the bottom and top members are fixed within the valve body, the middle member is displaced to a valve recess and the ram covers and seals the outlet flow path of the valve.

The valve is adapted to be attached between production casing of a production wellhead and a production tree. The production tubing is supported within the valve body. Production flow path is achieved by coupling of the punch out tube to the production tubing and the flow path of an annular packoff.

The production tree or a tubular extension to the tree is attached to the top of the valve body. A method and means for accomplishing the method are provided for replacing the punch out tube without removing the production tree from the valve body. A method for installing the valve between a production wellhead and a production tree is also provided.

37 Claims, 16 Drawing Figures

131
132
101'
130
133
103
102
100
101
10
105
105
13
21
82
104
120
40
72
64
80
15
55
50
66
31
36
35
32
34
19
20
25
26
16
12
27
70
54
53
52
42
33
71
65
38
90
62
63
60
61
110
37
29
28
30
79
78
71
60
55
54
53

303
309
310
301
300
308
304
101'
138
133
139
140
101

SAFETY VALVE APPARATUS AND METHOD

BACKGROUND OF THE INVENTION

1. Field of the Invention

The invention relates in general to a safety valve apparatus and a method for its installation and replacement of valve elements. Specifically, the invention relates to a production well valve apparatus which functions as a blowout preventer. More specifically, the invention is directed for use on offshore production platforms where a plurality of producing oil wells are disposed in close proximity to one another where there is an emergency need to simultaneously shut in all the producing wells rapidly safely, reliably, and economically while facilitating rapid resumption of production after the emergency has passed.

2. Description of the Prior Art

On marine production platforms there are often many producing wells in close proximity to one another. Each of the wells typically has a production wellhead from which production tubing extends from the well. The wellhead typically has a production or "Christmas" tree connected to it for controlling the gas or fluid flowing in the production tubing during production of the well. A master gate valve disposed in each production tree may be closed to shut off flow from the well, but such gate valves may be difficult to close rapidly during an emergency due to their location and indeed may not be available as where the production tree is removed from the wellhead during workover of the well.

Downhole safety valves may also be provided in each of the producing wells. There is always the danger that a downhole safety valve may not be operable or in place during workover of the well. As indicated above, during workover, the production tree may have been removed in order to install a blowout preventer stack atop the production wellhead for control of the well during workover. Such a blowout preventer stack is of the kind used typically in drilling operations and includes one or more ram-type blowout preventers and an annular blowout preventer. Until the blowout preventer is installed on the production wellhead and connected to its controls, well control in the past for the well has depended upon remotely installed plugs in the well. Such plugs have not always been reliable.

During an emergency on a offshore platform, for example where a fire or leaking gas or fluid from one production tree endangers all of the wells and indeed the platform itself, there has developed the need for an apparatus and method for its installation and refurbishing which may be used to rapidly close off the flow path of the production tubing in each of the wells.

As indicated above, a shear ram blowout preventer similar to those used in marine blowout preventer stacks for drilling operations could be a candidate for satisfying such a need. The use of a shear ram blowout preventer has a major disadvantage in that the tubing above the tubing hanger must be replaced after it has been sheared before production can be resumed. Shear ram blowout preventers crush the production tubing which must be replaced before the well can be put back into operation. In order to replace the crushed tubing, the production tree must be removed and a drilling blowout preventer and rig installed in order to remove the damaged tubing and replace it with new tubing.

Another disadvantage of using a shear ram blowout preventer similar to that used in drilling operations is that after the preventer crushes and shears the tubing, the well can only be controlled by pumping mud into it to control the pressure in the well. A plug typically cannot be installed through the tubing which has been crushed during the shearing by the preventer.

Another disadvantage of using a shear ram blowout preventer as a production well blowout preventer is that a typical shear ram is a large, bulky device requiring a large amount of platform space. Such space comes at very high cost on production platforms.

There have been prior attempts to find production well blowout preventers which satisfy the needs identified above. For example, U.S. Pat. No. 3,716,068 to Addison discloses a valve apparatus for controlling flow through a flow line and is adapted for use in a producing oil well. The valve apparatus includes a housing adapted to be mounted about the flow line and a flow blocking means mounted in the housing for movement toward the flow line. A boring tip on a wedge-like boring member is used to bore through a soft plug of the housing and then to establish a hole in the production tubing itself. The wedge-like flow blocking member bores and eventually shears the production tubing, thereby interrupting the flow in the production tubing. Protective seals are provided in the housing of the apparatus in order to protect the boring means from contamination.

In U.S. Pat. No. 1,851,894 issued to Clough, a control device for oil or gas wells is illustrated in which a boring apparatus drills through a protective seal of an annulus and through a production tubing thereby interrupting any flow which happened to be in the annulus and in the production tubing.

The patents mentioned above represent but two attempts over the years to provide shearing and sealing apparatus in order to interrupt the flow in a producing oil well. There has existed a continuing need to provide a safety valve adapted for controlling flow in production tubing in a producing well which is capable of automatic operation on a single well where a dangerous hazard has developed and on all wells on a producing platform. It is a major object of this invention to provide a producing well blowout preventer in which only a small element is replaced after the valve has closed and which does not require that the production tree be removed in order to replace the disposable part.

It is a further object of the invention to provide a safety valve in a producing oil or gas well which can be immediately put back into production after the valve has been closed and in which the valve might be put into its ordinary standby condition at a later time.

It is another object of the invention to provide a safety valve for use in a producing oil well in which after the safety valve has been actuated and the well put back into production, full access to the well is available into the production tubing for killing the well with drilling fluid and the like, setting plugs, etc.

It is a further object of the invention to provide a production well blowout preventer in which the seals and working mechanism of the preventer are isolated from the fluids flowing through the production line.

It is a further object of the invention to provide a production well blowout preventer which may be pressure tested to full working pressure after it has been actuated and prior to the removal of the production tree.

It is a further object of the invention to provide a punch out tube for the valve in which a middle member of the tube may be easily and cleanly displaced from upper and lower members fixed in the valve by ramming its side.

It is a still further object of the invention to provide a blowout preventer and method for its installation on production wells.

It is a still further object of the invention to provide a production well blowout preventer and a method for replacing a punch out tube in the preventer after the preventer has been actuated and the well put back into production without the necessity of removing the production tree above the preventer.

SUMMARY

The objects discussed above as well as other advantages and features of the invention are provided in a safety valve or blowout preventer adapted for controlling flow in production tubing installed in a producing well between the production wellhead and a production or "Christmas" tree. The valve includes a valve body having an axial bore with means for supporting a hanger means in the bore for securing the well production tubing extending into the well through production casing. The bottom part of the body includes a flange for connecting the valve to the casing head and sealing about the production casing.

Means are provided within the axial bore of the body for supporting a packoff means above the tubing hanger means. The packoff means has an axial flow path axially aligned with the production tubing disposed in the tubing hanger below.

Means are provided at the top of the valve body for connection to the production tree and for connecting the axial bore of the packoff means to the flow path of the production tree. The top of the valve body is also adapted for connection to a drilling blowout preventer stack during installation of the production tubing or during workover of the producing well. A punch out tube means is disposed between the packoff means and the tubing hanger means where the bore of the punch out tube means is axially aligned and sealed with the well production tubing below and the flow path of the packoff means above. A ramming gate assembly is provided laterally in the valve member having a gate ram laterally aligned with the punch out tube for ramming the punch out tube when an actuating means is actuated whereby a ramming member moves laterally against the side of the punch out tube displacing a portion of it until the gate ram closes off the flow path from the production tube means to the bore of the packoff means above. A seal on the gate ram engages the packoff means preventing axial flow upwardly to the production tree.

According to the invention, the punch out tube, which is placed in series with the flow line, comprises a bottom cylindrical member having a groove provided in its top end surface and extending around the circumference of the top end of the surface. A top cylindrical member is provided having a groove in its bottom end surface which likewise extends around the circumference of its bottom end surface and a middle cylindrical member having a groove provided in its bottom end surface and a groove provided in its top end surface, said grooves in the bottom end surface and the top end surface extending around the circumference of the top and bottom end surfaces. The top, bottom and middle cylindrical members are stacked one on top of another whereby the bottom end surface of the middle cylindrical member abuts the top end surface of the bottom cylindrical member and the grooves in the abutting surfaces cooperate to form a circumferential channel in the abutting middle and top members and the abutting middle and bottom members.

According to the invention, an actuator means is provided for actuating the gate ram means by which a gate member rams the punch out tube. The actuator means includes a locking arrangement for automatically locking the actuator means in an actuated position and for maintaining the ramming means in the closed position to prevent flow to the flow path opening of the packoff means. A means for manually releasing the locking means is also provided.

The safety valve of the invention also includes means for sealingly attaching the bore of the valve body to production casing of the production wellhead. An outlet means in the wall of the valve body is provided having communication with the bore of the valve body for releasing any gas or fluid in the annulus between the inside of the casing and the outside of the production tubing. A pocket above the annular packing means is provided so that the punch out tube may be replaced after the valve has been actuated during an emergency. The annular packoff means may be moved upwardly into the pocket and the gate ram means may be removed from the lateral slot in the body allowing sufficient room for the replacement of the punch out tube. Such an arrangement is advantageously provided so that the punch out tube may be replaced without removing the production tree attached to the valve body.

The invention also includes means for controlling two or more production tubes in a production well by providing two or more punch out tube means and two or more gate means laterally disposed to the punch out means for closing off and sealing the flow paths of the two or more production tubes.

A method is provided according to the invention for replacing the punch out tube after the emergency closure of the valve without removing the production tree atop the valve.

A method is also provided for installing the production blowout preventer between the production wellhead and a production tree.

BRIEF DESCRIPTION OF THE DRAWINGS

The invention will be better understood and further objects, characterizing features, advantages and details thereof will appear more clearly as the following detailed description proceeds with reference to the accompanying drawings of which.

DESCRIPTION OF THE INVENTION

Description of the Valve Apparatus

Figure 1:
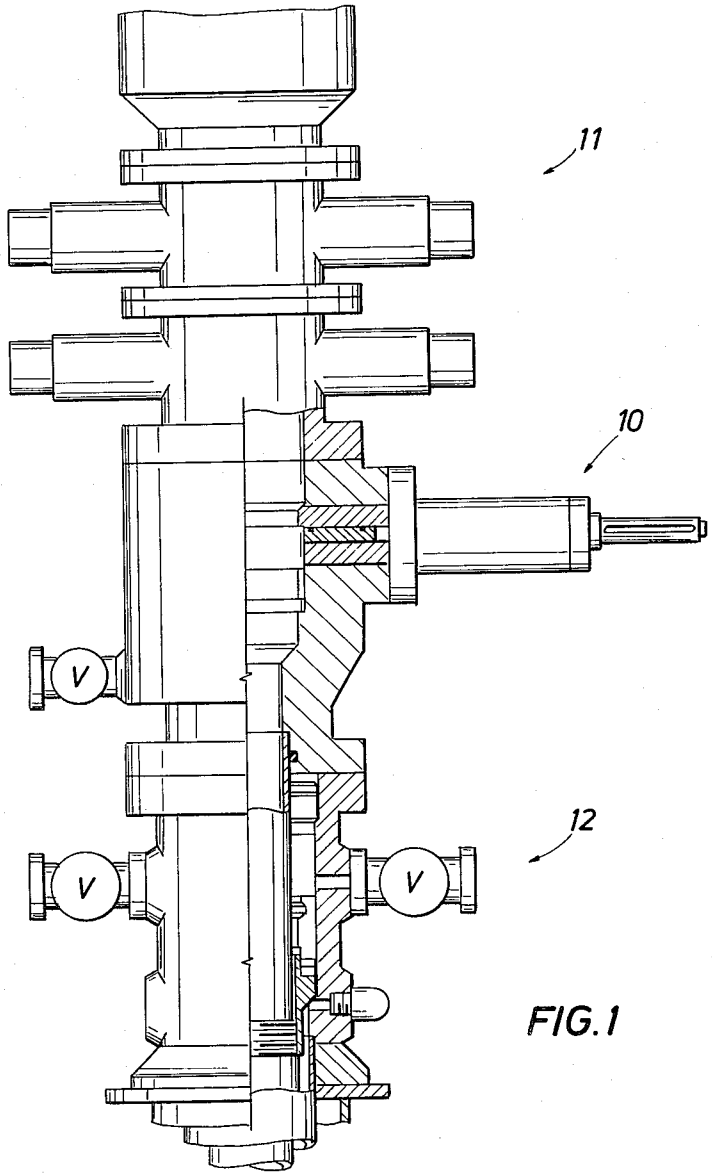
FIG. 1 is a illustration of the production well blowout preventer in place atop a production wellhead and having a drilling type blowout preventer stack attached to its top for completion operations in the well.

FIG. 1 illustrates the body of the safety valve or production blowout preventer shown generally at 10 during installation of production tubing which is disposed between a blowout preventer stack shown generally at 11 and a production wellhead apparatus shown generally at 12.

Figure 2:
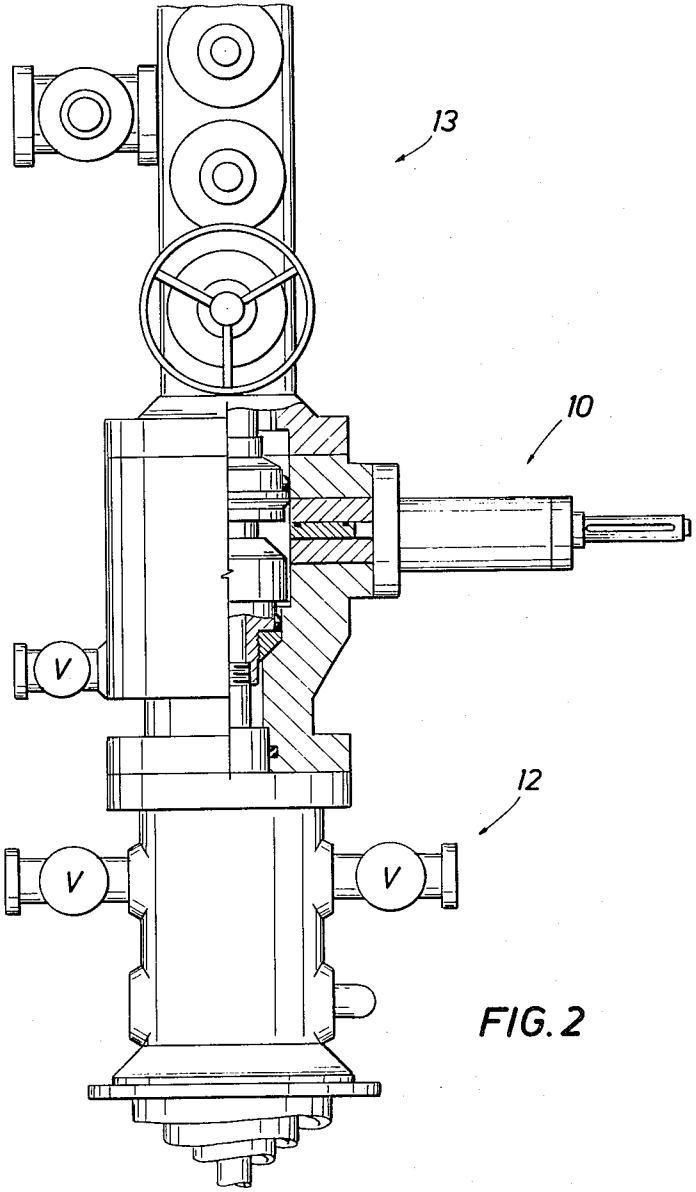
FIG. 2 shows the production blowout preventer according to the invention in place between the production wellhead and a production "Christmas" tree.

FIG. 2 illustrates the production blowout preventer 10 after production tubing and other apparatus has been inserted into the well through blowout preventer stack 11 and after a production tree 13 has been attached for controlling the production of gas and fluid from the well.

Although not illustrated in FIG. 2, a tubular extension may be provided between the production tree 13 and the blowout preventer 10 providing a safe distance between the tree 13 and its valves which may leak and be subject to a fire and the production blowout preventer 10 which is adapted to close off flow in production tubing during an emergency. A tubular extension also allows the blowout preventer to be located on a lower deck and the production tree on an upper deck as is common on offshore production platforms. Other platforms will use the arrangement of the blowout preventer 10 connected directly to the tree 13 as illustrated.

Figures 3, 3A:
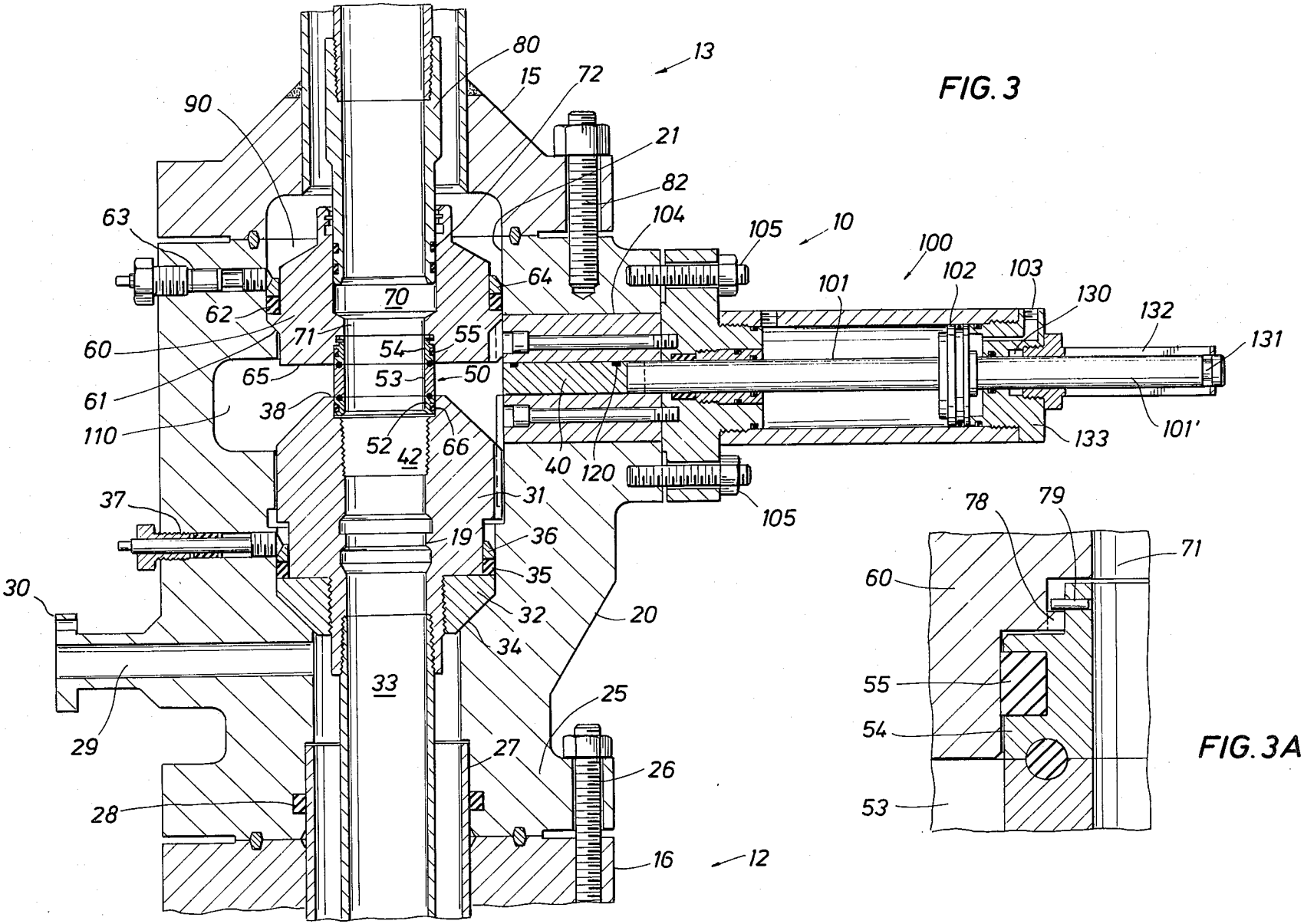
FIG. 3 shows a cross-section through the safety valve according to the invention which is adapted for use as a production well blowout preventer and FIG. 3A shows an enlarged detail of the method of attaching and sealing the punch out tube to a packoff means.

FIG. 3 shows an axial cross-section of the blowout preventer 10 and illustrates the connection of the blowout preventer to the body 15 of production tree 13 and the body 16 of the production wellhead 12. The safety valve adapted for use as a blowout preventer 10 includes a body 20 having an axial bore 21 extending axially along the body.

The lower portion of the blowout preventer body 20 is attached to the body of the wellhead 16 by means of a flange 25 sealingly attached to the wellhead body 16 by means of bolts 26. The body of the valve is adapted to sealingly engage the production casing 27 by means of a seal 28. An outlet 29 is provided in the wall of the body 20 in communication with the interior of the production casing 27. Such an opening may be used to relieve pressure resulting from leakage in the production casing 27 and may be connected to a valve means or gauges and the like by means of flange 30.

A tubing hanger 31 including tubing plug recesses 19 is threadingly connected to a landing ring 32. The tubing hanger and landing ring are connected to a production tubing for insertion into the well within production casing 27 via the top of bore 21 of body 20. As the tubing hanger 31 and tubing 33 are lowered into the well, the tubing hanger 31 and landing ring 32 are supported by shoulder 34 within body 20. A seal means 25 seals the interior of the body 20 to tubing hanger 31. A metal ring 36 in cooperation with lock screws 37 forces the metal ring 36 downwardly and insures sealing of seal means 35. Preferably eight lock screws 37 are provided about the periphery of the body 20, the exact number depending on the diameter of the body and the pressure rating of the wellhead. The engagement of lock screws 37 also serves to retain the tubing hanger in place.

The tubing 33 is in communication with the axial opening 42 of tubing hanger 31 which secures the bottom portion 52 of punch out tube 50. Punch out tube 50 is to be described in detail below as a composite of three members, a lower tubular member 52, a middle tubular member 53 and an upper tubular member 54. A seal 66 seals the bottom portion of punch out tube 50 within the bore 42 of tubing hanger 31. The top portion 54 of punch out tube 50 is sealed by seal 55 within an annular packoff member 60 which is supported in the bore 21 of body 20 by means of a landing shoulder 61.

FIG. 3A illustrates the securing of the top portion 54 of punch out tube 50 to packoff member 60 with the axial bore of punch out tube 50 in alignment with bore 71 of packoff member 60. Preferably a pin 79 attached to upper cylindrical member 54 is supported by shoulder 78 in packoff member 60. According to the invention it is preferable to support the punch out tube 50 from the packoff member 60 rather than from the tubing means so that upper tubular member 54 remains attached to the packoff after the middle tubular member 53 has been rammed and displaced by ramming member 40 and does not fall downwardly into the bore 42.

The packoff member 60 is sealed within the body 20 by means of a seal 62 and is secured in place by means of lock screws 63. Lock screws 63 act on a metallic ring 64 to engage seal 62 and force the packoff 60 axially downward against shoulder 61.

The upper part of the packoff member 60 has a bore 70 in communication with a lower bore 71 which is aligned with the punch out tube 50. The upper part of the bore 70 is adapted to communicate with the conduit 80 of the production tree 13 (or alternatively of a drilling blowout preventer stack). The conduit 80 includes seals 72 for sealing against the bore 70 in packoff 60. Bolts 82 are adapted to attach either the body of a production tree 13 to the top of the body of the production blowout preventer 20, or a drilling blowout preventer stack may be attached thereto by bolts 82 as illustrated in FIG. 1.

A space or pocket 90 is provided in the top of the bore of the body 20 such that the annular packing ring 60 may be moved upwardly within the bore 21 to facilitate the replacement of punch out tube 50. Such replacement will be described in more detail below.

A ram gate means shown generally at 100 is provided for insertion within a lateral hole 104 in valve body 20. Ram gate means 100 includes a ramming member 40 attached to the end of a ram 101 which may be driven inwardly by piston 102. The piston may be driven by means of hydraulic fluid through line 103 which drives piston 102, ram 101 and ramming member 40 laterally inwardly within the body 20 toward the side of punch out tube 50. Manual means could, of course, be provided to force ramming member 40 laterally across the bore 21 of body 20. The ram gate means 100 is inserted into hole 104 and is secured to the body 20 by means of bolts 105.

Figure 9A:
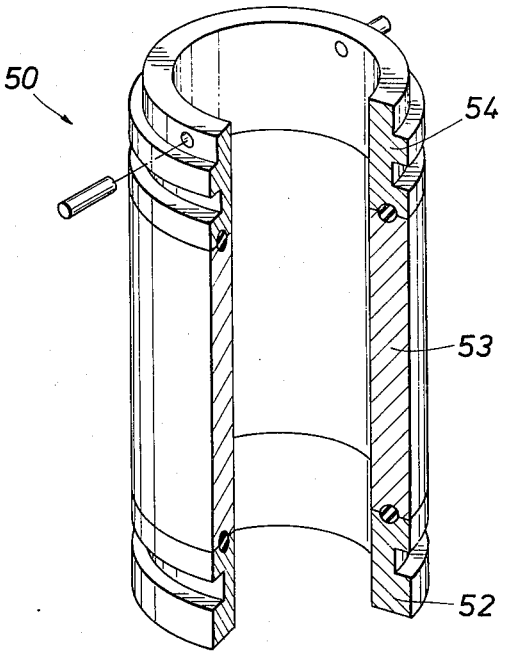
FIGS. 9A and 9B illustrate construction details of a preferred and an alternative punch out tube.

As illustrated in more detail in FIG. 9A, punch out tube 50 comprises a stacked composite of three cylindrical members: a lower cylindrical member 52 having a top end surface with a groove provided in the surface, a middle cylindrical member 53 having bottom and top end faces having grooves around the circumference thereof and an upper cylindrical member 54 having a bottom end face with a circumferential groove in its end surface. The lower member 52, the middle member 53 and upper member 54 are stacked on top of each other. The top end face of bottom member 52 abuts the bottom end face of middle member 53 and the top end face of middle member 53 abuts the bottom end face of top member 54.

The grooves in abutting end faces cooperate to form a circumferential channel between the bottom member 52 and the middle member 53 and between the middle member 53 and the top member 54. In a preferred embodiment of the punch out tube 50, the stacked members 52, 53, and 54 are steel cylinders. The grooves are first thoroughly cleaned and degreased. A bonding agent is then applied to the grooves and allowed to dry. Raw rubber is then placed in the grooves resulting from stacking members 52, 53 and 54. Pressure and heat applied to the members creates a stacked composite 50 in which the raw rubber is vulcanized and in which a strong bond is created between the rubber and the metal of the cylindrical members. Such a construction is advantageous when the resulting punch out tube 50 is used in production blowout preventer 10 of FIG. 3, because as it is rammed from the side of middle member 53, the middle member is displaced laterally from members 52 and 54 fixed with retaining recesses below and above, the vulcanized rubber in the grooves between members 52 and 53, and between 53 and 54 tearing rather than pulling away from their bonding to the metal surface. Thus, middle member 53 is easily displaced laterally after being rammed from its side.

The rubber in the grooves also serves to seal the lower, middle and upper members thereby preventing leakage of pressurized gas or fluid flowing in the tube.

Figure 9B:
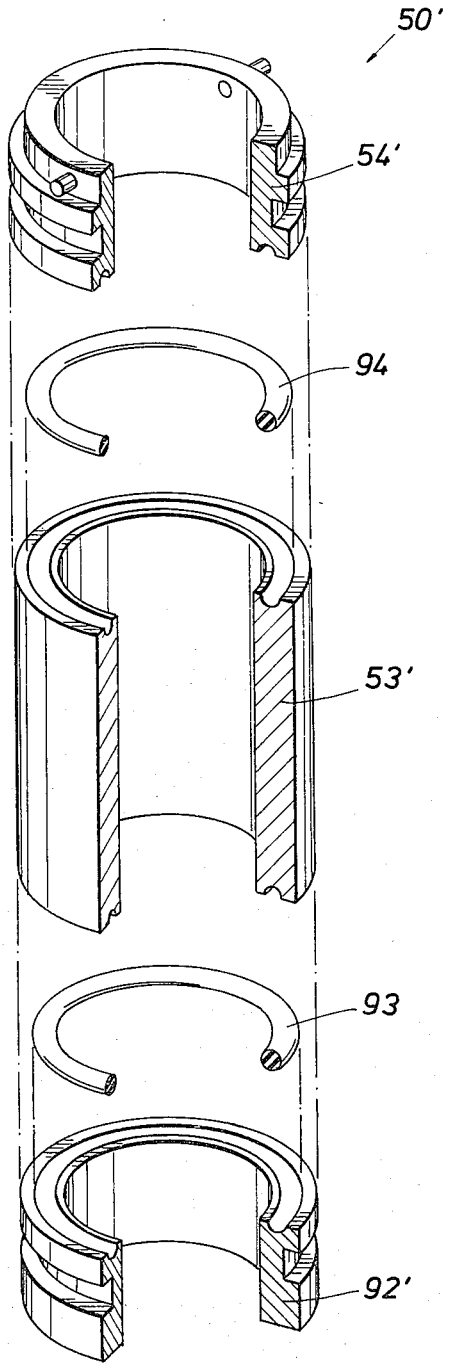

FIG. 9B illustrates an alternative way of providing punch out tube 50. A stacking 50' includes lower member 52', middle member 53' and upper member 54' with "O" rings placed in the grooves of the end surfaces of lower member 52' and middle member 53'. Such "O" rings may be constructed of an elastomer such as rubber or may be of synthetic flourine containing resins moulded to fit within the resulting channels. Another alternative construction for the punch out tube is to fabricate the cylindrical lower, middle and upper members from fiberglass or plastics.

Figure 4B:
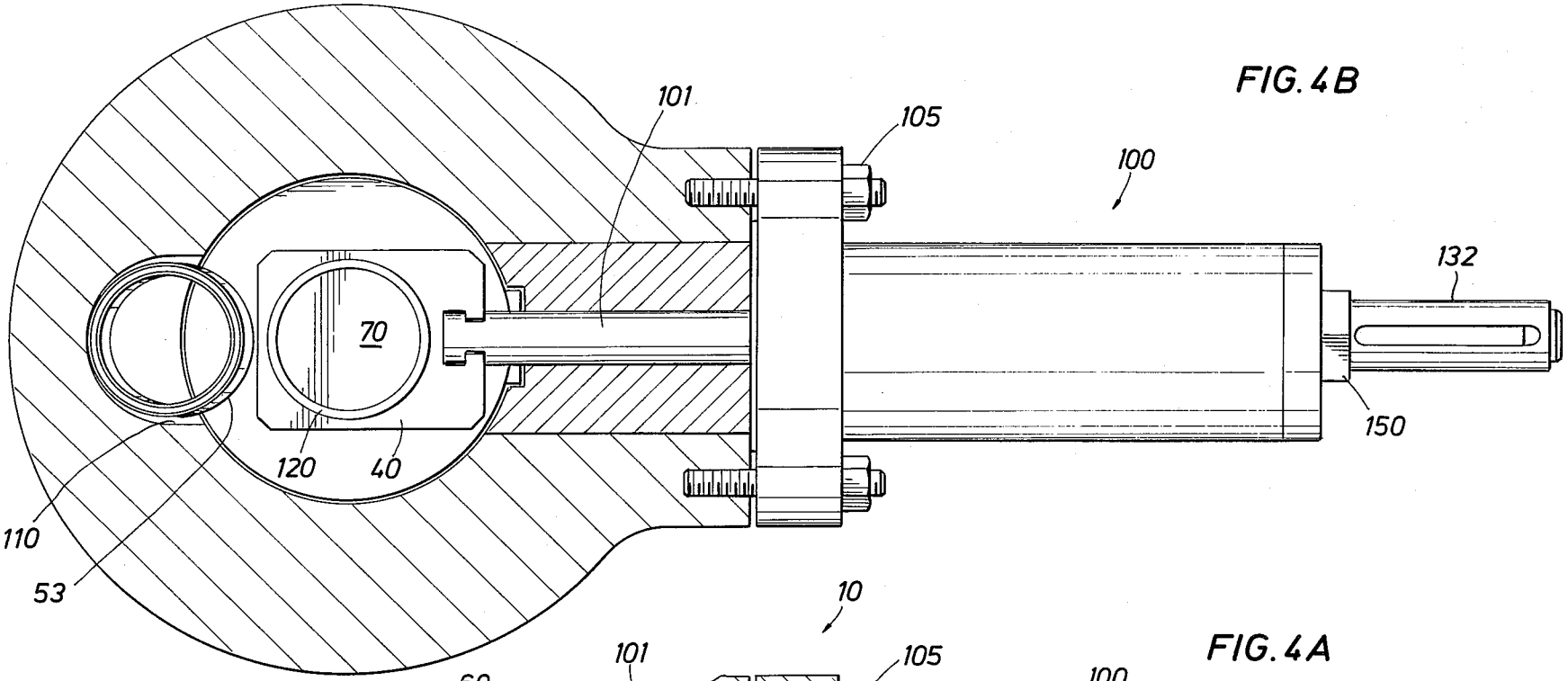
FIGS. 4A and 4B show cross-sections of the valve member after a ramming member has rammed and displaced a portion of a punch out tube from the flow path of the valve and has sealed off flow from the production tubing.
Figure 4A:
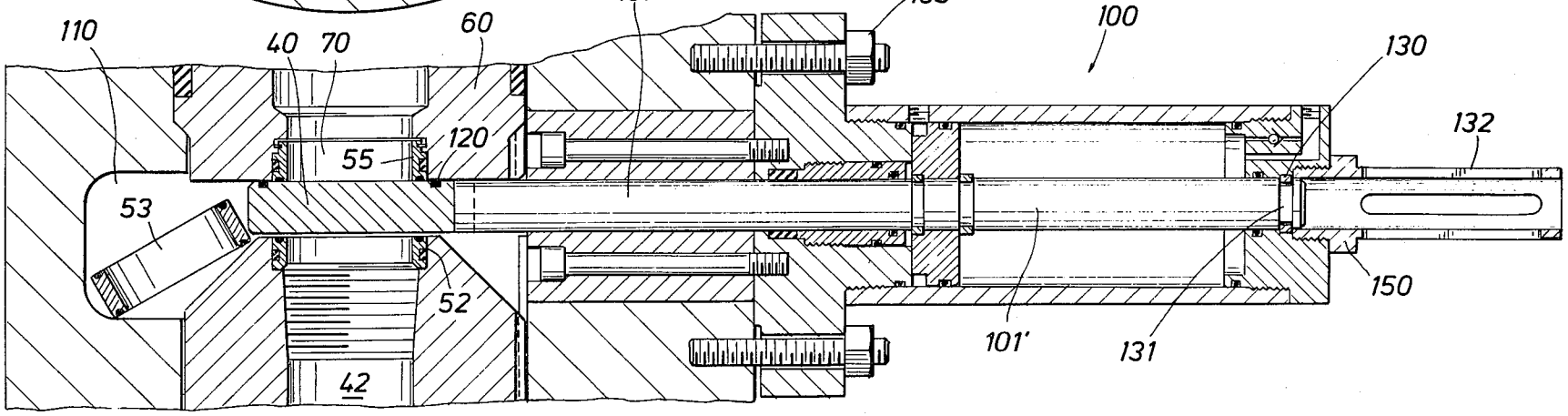

FIG. 4A illustrates the status of the blowout preventer 10 after the ram gate member 100 has been actuated and ram 101 with its attached ramming member 40 has rammed the side of the punch out tube 50 driving the middle section 53 of the punch out tube 50 laterally into recess 110. A substantially cylindrical sealing member 120 disposed on the top surface of ramming member 40 seals about the bore 70 in upper packoff member 60 as illustrated in FIG. 4A. Alternatively, seal 120 may be disposed in the bottom surface of packoff means 60.

FIG. 4B illustrates in a cross-section view through the top part of the ramming member 40 and ram gate means 100, the status of the blowout preventer or safety valve 10 after it has been closed during an emergency. FIG. 4B also shows that middle member 53 of punch out tube 50 has been displaced laterally into recess 110 of body 20 and that the ramming member 40 of ram gate means 100 covers the bore 70 of the upper packoff member 60. FIG. 4B illustrates that the seal 120 is provided for sealing against fluid or gas from the production tubing.

Returning to FIG. 4A, it is apparent that fluid or gas from production tubing 33 may continue to flow into the valve body 20 into recess 110 and to the sides and beneath the ram gate member 40, but that such flow has been prevented from continuing upwardly into the bore 70 of packoff means which is in communication with the production tree above.

Thus, the blowout preventer or safety valve, according to the invention provides a means for the emergency control of the well by completely shutting off gas or fluid transmission to the production tree where the danger of fire, especially where many such wells are in close proximity on a marine production platform presents an extremely serious hazard.

An advantageous feature of the invention is apparent from FIG. 3 in that during normal operation of the producing well, flow is via the production tubing 33 through the punch out tube 50, and upwardly through the bore 70 of annular packoff means 60 and into the production tree 13. The ram gate means 100 and its seal 120 is never in contact with the production fluids. It is often the case that such production fluids contain corrosive agents such as $H_2S$ and other materials which have an adverse effect on seals and valve mechanisms over long periods of time. Thus, the blowout preventer mechanisms and seals of the apparatus according to the invention are not subject to deterioration over long working periods during the producing life of a well, yet remain effective for control of the well during an emergency such as a fire or the like on an individual well or on a production platform where many wells may be in close proximity with one another.

FIG. 4A illustrates another advantageous feature of the invention in that after an emergency has occurred and the blowout preventer has been actuated where ramming member 40 has rammed the middle section 53 of punch out tube 50 to the recess 110 and has sealed off the bore 70 of the upper part of the valve, the production fluid does indeed contact the working part of the valve. But because the valve has worked satisfactorily, such contact for a short period of time is of no real concern. FIGS. 4A and 4B also illustrate the provision of a locking means which automatically prevents ram 101 from being retracted after it has been forced laterally into the body 20. Expansion ring 131, disposed in a recess in the outward end 101' of ram 101 is maintained in compression by housing 132 until ram 101 is forced inwardly into the valve body by piston 102. After the ram 101 has moved inwardly sufficiently to ram punch out tube 50, expansion ring 131 springs outwardly into recess 130 in housing 133 automatically locking ram 101 in a closed position. Such automatic locking assures that the valve remains closed except by the manual disengagement of member 150 in order to withdraw ramming means 40 from preventing flow to bore 70 above the valve.

Figure 6A:
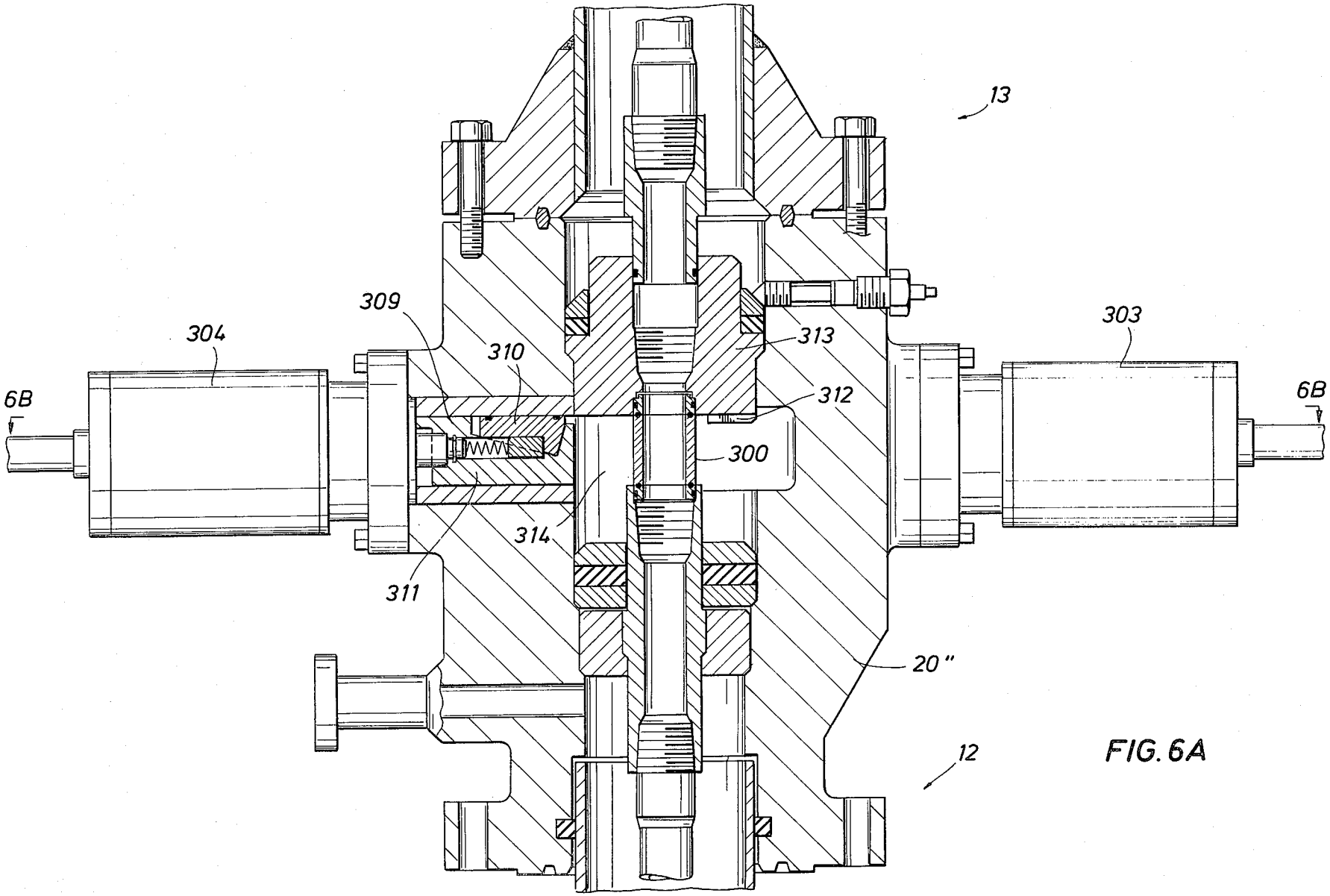
FIGS. 6A and 6B illustrate an alternative embodiment of the invention adapted as a production blowout preventer having means for controlling flow through two production tubes, the preventer having punch out tubes disposed in the preventer of the body at the same axial location, but in which the ramming members are spaced angularly about the body of the preventer so that one ramming member is provided to ram one punch out tube from one side, the other ramming member is provided to ram the other punch out tube from the other side.
Figures 6B, 8A, 8B:
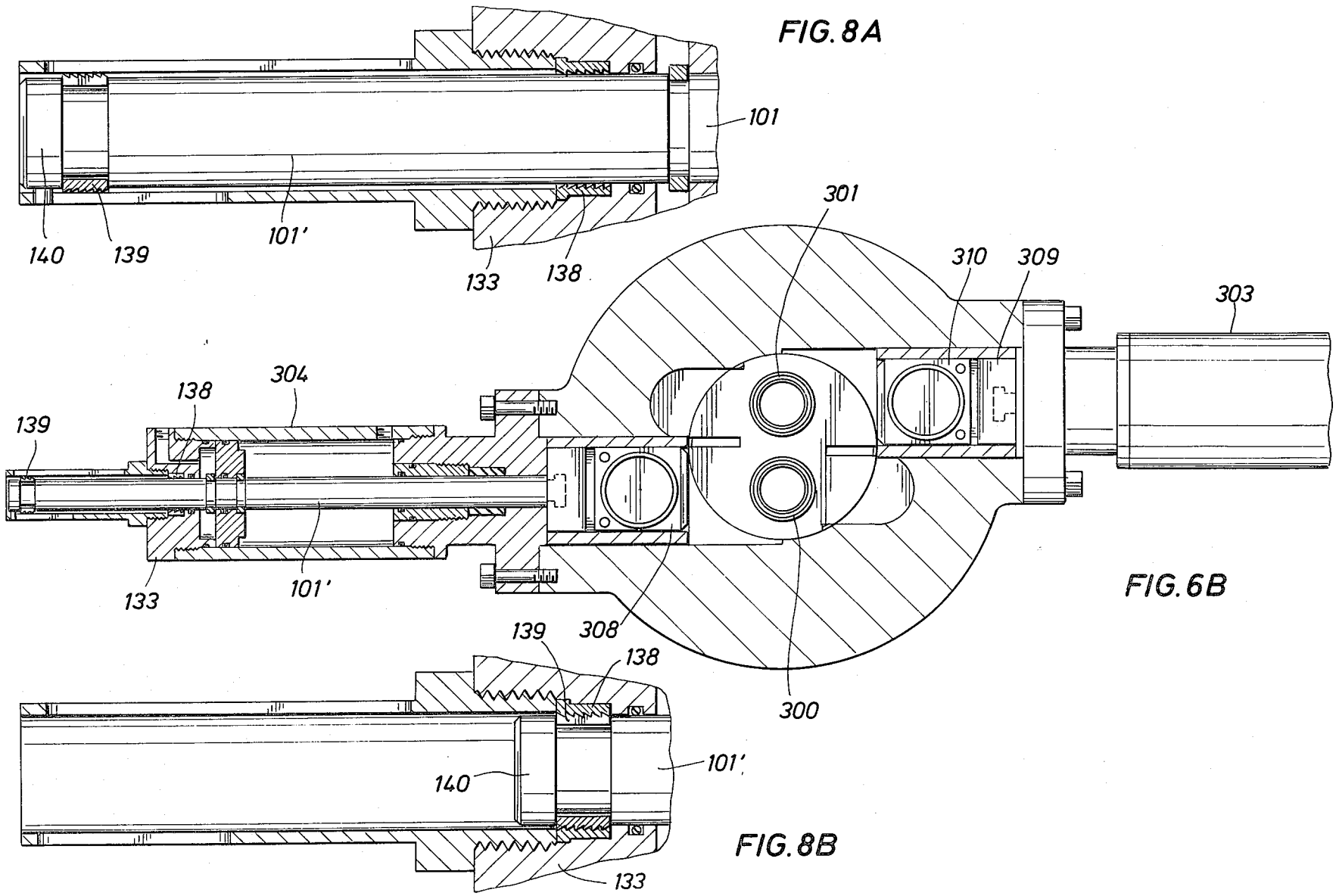
FIGS. 8A and 8B illustrate an alternative locking means for automatically locking the ramming means in a closed position when the production blowout preventer is closed.

FIGS. 8A and 8B show an alternative automatic locking means by which ram 101 is automatically locked on closing. A ring 138 having one way ratchet teeth is mounted on housing about outward extension 101' of ram 101. A ring 139 having oppositely facing ratchet teeth is provided outwardly on the outward extension 101'. As the ram 101 is closed, ratchet teeth on ring 139 move past the ratchet teeth on ring 138 until the ram reaches its full lateral extension, but automatically prevent withdrawal of the ram until ring 140 on the end of outward extension 101' is manually removed.

FIG. 4A also illustrates that if the blowout preventer 10 were actuated by mistake, or if the hazard which required its activation has passed, the ram 101 may be withdrawn from valve 10 by manually disengaging member 150 and withdrawing the ram. Such withdrawing of the ramming member 40 allows production flow once again from the production tubing 33 from the well into the production tree via bore 70. It is apparent that wellbore fluid will continue to be in recess 110 and space 111 as illustrated in FIG. 4A, but the production has easily, rapidly and economically been restored. The advantages of being able to restore production in a producing well after a blowout preventer has been actuated are apparent when compared to the shearing type blowout preventer discussed in the Background of the Invention section of this specification. The well may continue to produce until such time as the refurbishing of the valve 10 in replacement of a punch out tube 50 may be made.

Returning to FIG. 3, an advantageous feature of space or pocket 90 at the top portion of the body 20 is apparent. When the valve 10 is to be refurbished after the punch out tube 50 has been rammed as in the case of reaction to an emergency at the well, the punch out tube 50 may be replaced via the lateral hole 104 in which the ram means 101 is disposed. After setting a plug in the tubing hanger, for example in recesses 19, or otherwise shutting off the production below the tubing hanger, the refurbishing is accomplished by first removing the ram gate means 100 from the lateral hole 104 by disengaging the bolts 105 holding the ram gate means within the body 20. Once the lateral slot is opened, the lock screws 63 are retracted allowing the packoff 60 to be urged upwardly within the bore 21 of body 20. The pocket 90 provided above the packoff 60 allows such upward movement of the packoff 60 and provides sufficient room for removal of the old punch out tube 50 and the middle portion 53 of it which may be residing in recess 110. A new punch out tube 50 may then be sealingly engaged in the recess of the bore 70 and the upper packoff 60 and may be reattached to the packoff 60. The ram gate means 100 may then be reinserted into hole 104 and the blowout preventer is again ready for operation when called upon to close off the production tubing in an emergency. The tubing plugs can be retrieved through the punch out tube 50 and through the production tree 13.

FIGS. 5 and 6 illustrate alternative embodiments of the invention where at least two production tubings are extending into a wellhead and in which the flow from either one or both production tubings may be closed during an emergency.

Figure 5A:
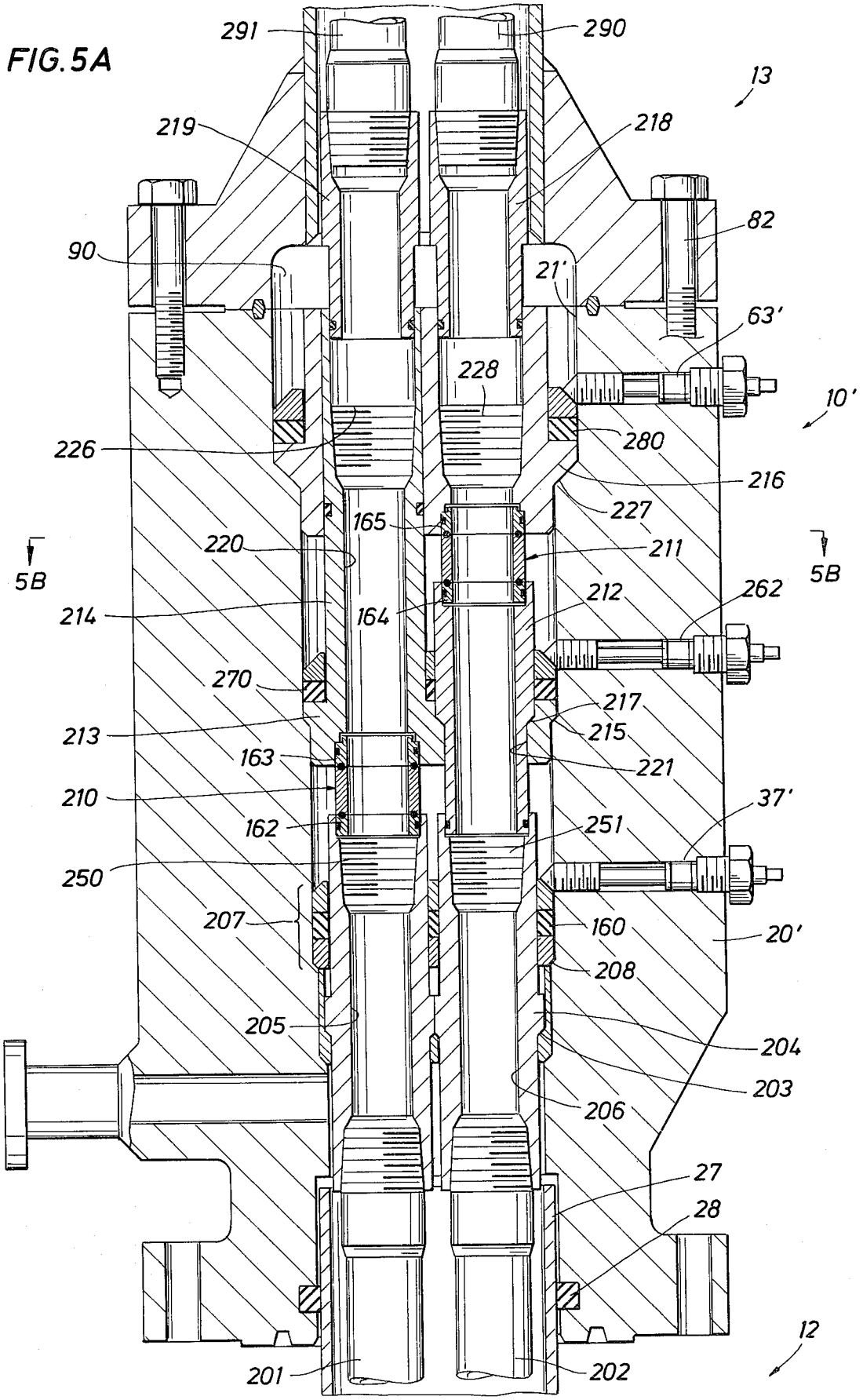
FIGS. 5A and 5B illustrate the invention adapted for use as a production blowout preventer having means for controlling flow through two production tubes, the preventer having punch out tubes spaced axially in the body of the preventer and having two ramming members on the same side of the body of the preventer but spaced axially in alignment with the two punch out tubes.

FIG. 5A illustrates a production well blowout preventer shown generally at 10' secured between a production tree 13 and a production wellhead 12. The production blowout preventer 10 includes a body 20' having an axial bore 21' therethrough. Disposed in the lower part of the body 20' is a tubing hanger means 204 supported within the bore by landing shoulder 203. Supported downwardly into the well by tubing hanger 204 are production tubings 201 and 202. Such tubings are connected through bores 205 and 206 in the hanging means 204 to openings 250 and 251 in the upper part of the tubing hanger means 204.

A first packoff means 207 including seal 160 serves to seal the tubing hanger means 204 with valve bore 21' and is supported at shoulder 208.

A second packoff means 213 is supported within the bore 21' of the body 20' by landing shoulder 215. The second packoff means includes two bores in it, the first illustrated as the bore 220 and the second as bore 221. A first punch out tube means 210 is sealingly secured between the bottom end 163 of the first bore 220 of the second packoff means 213 and the top 162 of the bore 250 of the tubing hanger means 204 which is in communication with the first production tubing 201. Extending upwardly within the bore 21' of the body 20' is a first tubing extension 214 in the upper part of the second packoff means 213. The upward end of the first tubing extension means 214 terminates in an opening 226.

Extending upwardly from the opening 251 of tubing hanger means 204 in flow communication with the second production tubing 202 is a second tubing extension member 212 which is supported within the second packoff means 213 by landing shoulder 217. A third packoff means 216 is supported within the bore 21' of the body 20' by means of a landing shoulder 227. The third packoff means 216 envelopes the upward end of the first tubular extension 214. A second bore 228 is disposed upwardly in the second packoff means 216 and is in angular and axial alignment with the second production tubing 202. Bores 226 and 228 of the first tubular extension 214 and the third packoff means 216 respectively are threaded to couple tubings 291 and 290 extending upwardly to production tree 13.

A second punch out tube 211 is sealingly secured between the bottom 165 of the second bore 228 of the third packoff means and the top 164 of second tubular extension 212. Punch out tubes 210 and 211 are of the same construction as described above in connection with FIGS. 9A or 9B and are sealingly secured between upper and lower bores in the same fashion as was illustrated in FIG. 3A.

Lock screws 37' operate to engage seal 160 of first packoff means 207 within bore 21'.

Lock screws 63' serve to energize seal 280 within bore 21'.

Figure 5B:
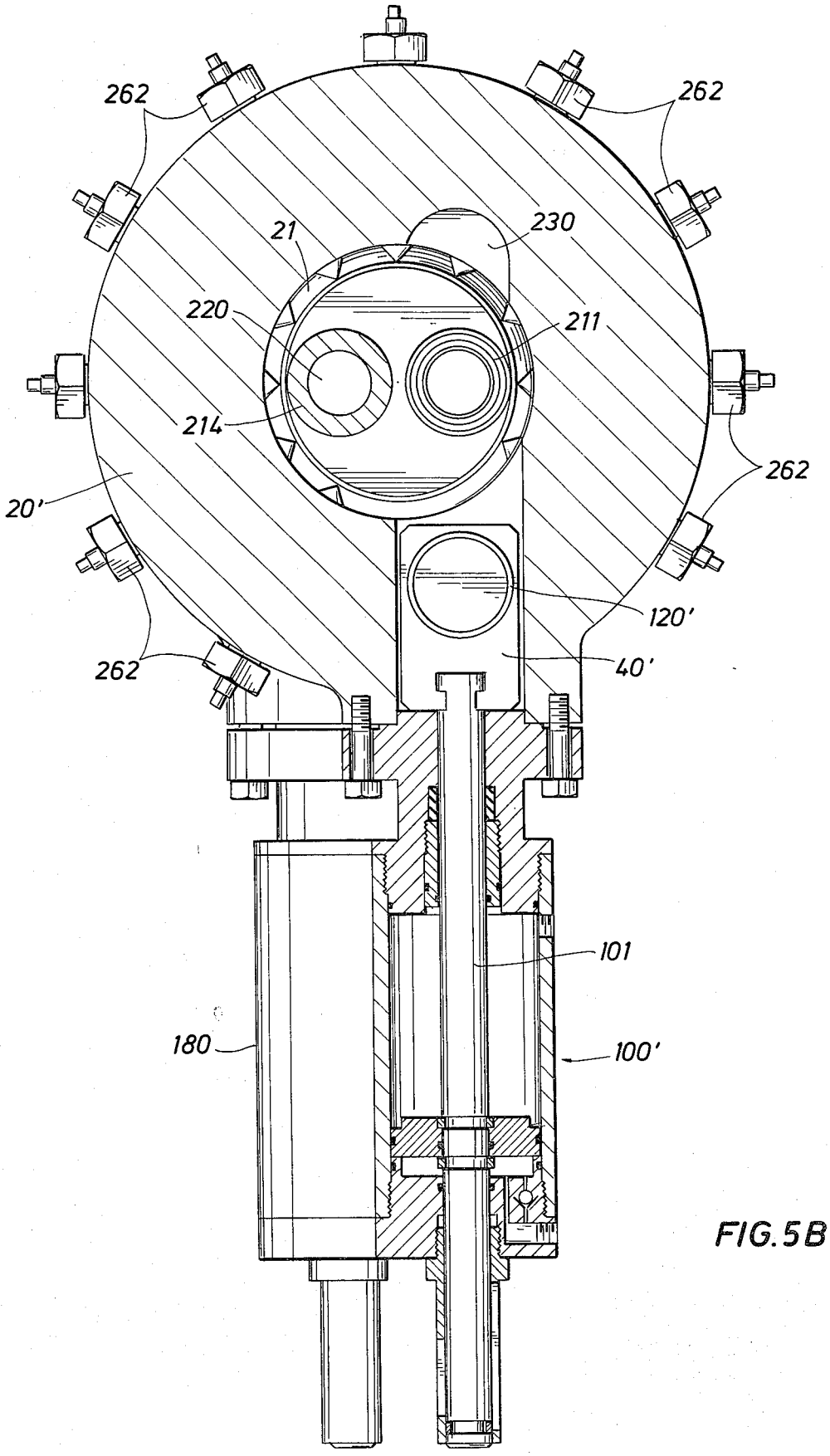

FIG. 5B shows a cross-sectional view through an upper end section of the middle cylindrical member of the punch out tube 211 and illustrates the body 20' having a bore 21' in which two ram actuators 100' and 180 are disposed on the same side of the body. As illustrated, the ram 101 is adapted to force ramming member 40′ having a seal 120′ on its top surface into engagement with the upper punch out tube 211. The recess 230 is provided for storing the middle section of upper punch out tube 211 when ramming member 40′ rams upper punch out tube 211 during an emergency. Either ram gate means 100′ or 180 or both may be actuated whereby the flow in the first or second production tubings 201, 202 may be interrupted and sealed against further communication with tubings 291 and 290 extending upwardly to the production tree 13.

Advantageously seal 270 of second packoff means 215 is provided between the upper punch out tube 211 and the lower punch out tube 210 and is disposed between the walls of the first tubing extension 214 and the second tubing extension 212 to prevent flow communication between tubing 201 and 202 when both punch out tubes 210 and 211 have been rammed.

FIGS. 6A and 6B illustrate an alternative embodiment of the production blowout preventer according to the invention, in which two production tubings are controlled by the production blowout preventer apparatus between the production wellhead 12 and the production tree 13. FIG. 6A illustrates the body 20″ in an axial cross-section through one of the punch out tubes 300 and illustrates that the two ram actuator means 303 and 304 are on opposite sides of the body 20″.

FIG. 6B illustrates that the punch out tubes 300 and 301 are side-by-side at the same axial position within the body. Ramming member 308 is provided to ram and displace punch out tube 300 while ramming member 309 is provided to ram and displace the punch out tube 301.

Figure 7A:
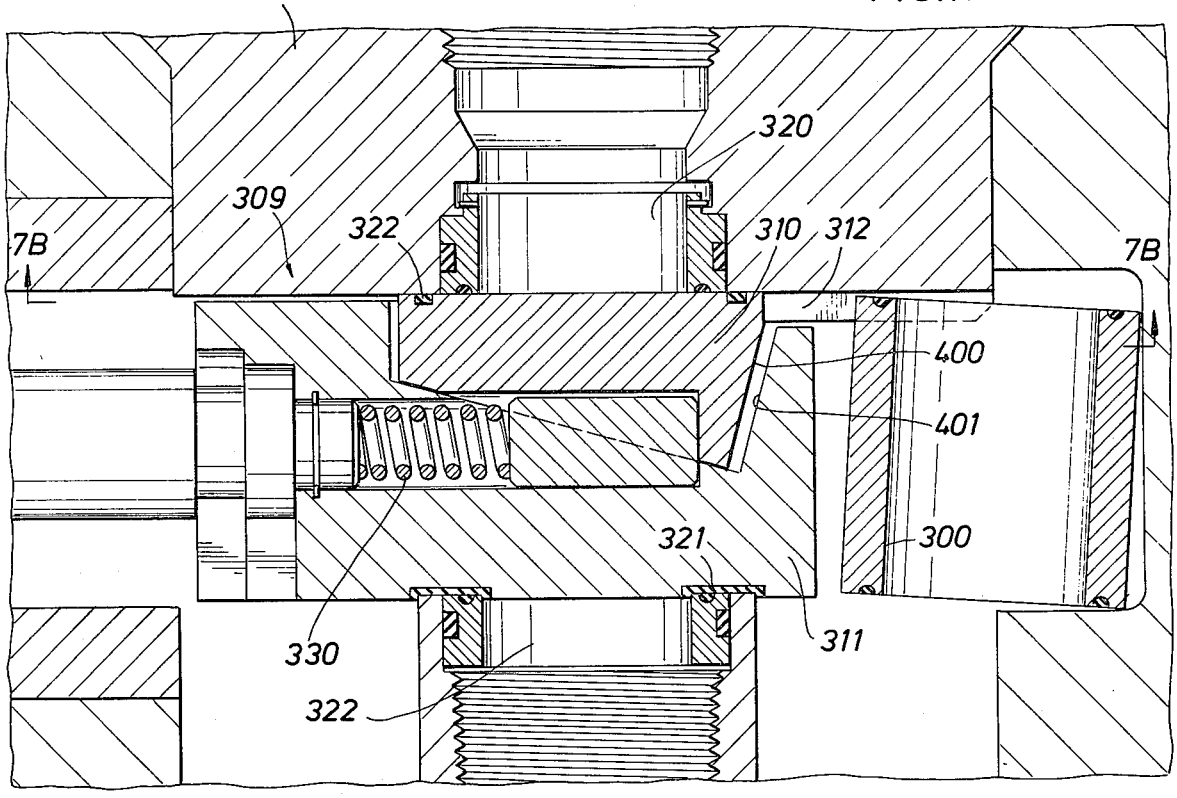
FIGS. 7A and 7B illustrate an alternative ramming member means for assuring sealing about the outlet side and the inlet side of the flow conduit after the punch out tube has been rammed and displaced by the ramming member.

Ramming member 309 is illustrated in FIG. 6A and in more detail in FIG. 7A. Ramming member 309 includes a wedge-like member 310 in cooperation with the primary ramming member 311. A shoulder stop 312 is provided on the opposite side of the packoff means 313 such that as the ramming member 309 proceeds across the slot 314 in order to ram punch out tube 300, wedge-like member 310 is prevented from further lateral movement. As illustrated in FIG. 7A, the wedge-like member 310 sealingly stops flow to the bore 320 of the outlet of the respective production tube by means of seal 322 engaging the surface about the bore 320 in upper packoff means 313.

Figure 7B:
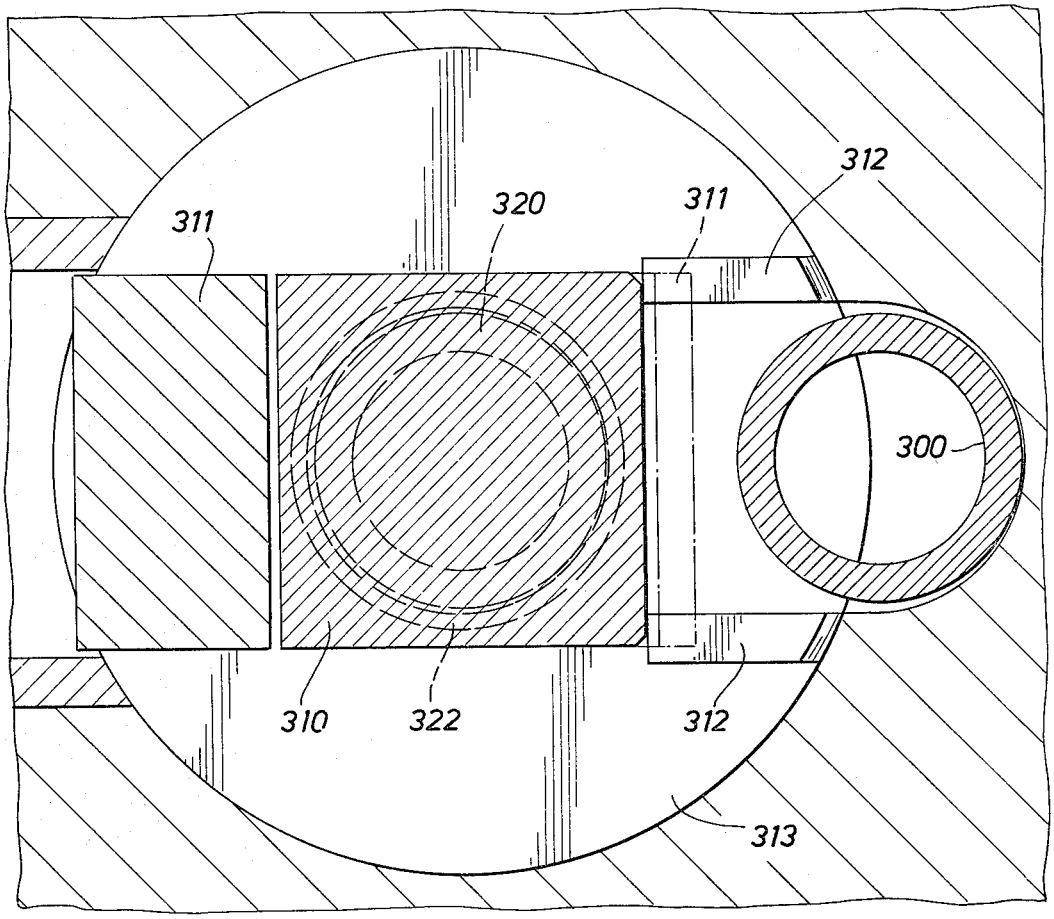

As the ram continues to close, the lower member 311 of ramming member 309 continues laterally across the wedging surface between the lower member 311 and the upper member 310 to cause seal 321 to sealingly stop flow from the bore 322 in communication with the production tubing extending into the well. Spring 330 acts to cause members 310 and 311 to move as a unit by forcing surfaces 400 and 401 against one another. After member 310 meets stop 312, member 311 continues moving laterally as illustrated in FIGS. 7A and 7B with the surface 401 moving away from surface 400. The lateral movement of member 311 wedging past member 310 urges member 310 upwardly and urges member 311 downwardly. Thus, the downward wedging force on member 311 allows the seal 321 to cover the bore of the respective tubing extending into the well and assures that communication between the bores of the two tubings is prevented during an emergency shut off of both of the production tubings and prevents communication between the two tubings which may extend into different formations in the well.

Thus there has been disclosed an emergency shut off valve especially adapted for use as a production blowout preventer. The valve could find application for emergency cut off purposes in lines flowing corrosive fluids or gas such as in refineries or nuclear reactors. In oil or gas wells it could be used as the lowermost master valve. According to the invention, the valve design includes a punch out tube which may be fabricated from or lined with corrosion resistant material to the corrosive fluid being carried in the line. The valve body, ramming mechanism and seals are isolated from the corrosive fluid being carried until the valve is actuated. The valve body may therefore be fabricated of a less expensive or a stronger material than ordinarily required for corrosion resistant long life. Once actuated, the valve has the features of an ordinary valve and may be operated as such until the valve is refurbished as an emergency valve again.

METHOD OF INSTALLATION AND REFURBISHING

The production blowout preventer 10 is attached to a production wellhead by attaching the bottom of the valve 10 to the top of production wellhead 12. As illustrated in FIG. 1, a drilling type blowout preventer stack may then be placed atop the body of the production blowout preventer so that control of the well by means of the blowout preventer stack 11 may be obtained during the installing of tubing in the well. The production tubing with a tubing hanger attached to the top of it is then lowered through the bore of the blowout preventer stack 11 through the bore 21 of the body 20 of the production blowout preventer 10 until the tubing hanger lands on a landing shoulder 34 illustrated in FIG. 3.

A punch out production tube 50 may then be sealingly attached within the upper packoff 60 and be lowered by means of a running tool into the bore 21 of body 20 until the bottom portion of the punch out tube 50 is sealingly secured without the top bore 42 of the tubing hangar 31. The lock screws 37 and 63 are then engaged whereby seal 62 is made up to seal between bore 21 and upper packoff 60. The drilling blowout preventer stack 11 is then removed from atop the blowout preventer body 20 and a production tree 13 as illustrated in FIG. 2 is attached which completes the assembly of a production well.

Various modifications and alterations in the described structures will be apparent to those skilled in the art of the foregoing description which does not depart from the spirit of the invention. For this reason, these changes are desired to be included in the appended claims. The appended claims recite the only limitations to the prevent invention in the descriptive manner which is employed for setting forth the embodiments and is to be interpreted as illustrative and not limitative.

What is claimed is:

1. A safety valve adapted for controlling flow in production tubing in a well comprising, a valve body having an axial bore therethrough, means within the axial bore of the body for supporting a hanging means for securing well production tubing, means within the axial bore of the body for supporting a packoff means within the body of the axial bore and disposed axially above the tubing hanger means, the packoff means having an axial flow path therethrough, punch out tube means disposed between the packoff means and the tubing hanger means, the bore of the punch out tube means being axially aligned with the well production tubing below and the flow path of the packoff means above, and ram gate means disposed in a lateral hole in the valve body and having a ramming member aligned with the wall of the punch out tube means for ramming the punch out tube means displacing at least a portion of the punch out tube from the flow path and sealing the flow path of the packoff means from communication with gas or fluid in the well production tubing.

2. The safety valve of claim 1 further comprising recess means in said body laterally opposite said ram gate means for receiving at least a portion of said punch out tube after it has been rammed by said ramming means.

3. The safety valve of claim 1 further comprising, means for sealing said hanging means within the axial bore of the body, and means for sealing said packoff means within the axial bore of the body.

4. The safety valve of claim 1 wherein said punch out tube is supported by securing means of the packoff means.

5. The safety valve of claim 1 wherein the ram gate means comprises a ramming member slidably disposed in the lateral hole in the valve body, the ramming member having a sealing means disposed in its upper surface, the sealing means having a minimum diameter larger than the flow path opening of the packoff means, and actuator means for forcing the ramming member laterally in the lateral slot of the valve body against the punch out tube, whereby the punch out tube is displaced from alignment with the flow path of the packoff means, the ramming means moves across the flow path of the packoff means, and the sealing means on the upper surface of the ramming means sealingly prevents flow to the flow path opening of the packoff means from the production tubing below.

6. The safety valve of claim 5 wherein the actuator means includes locking means for automatically locking the actuator means in an actuated position and maintaining the ramming means in position to prevent flow to the flow path opening of the packoff means, and means for manually releasing the locking means.

7. The safety valve of claim 1 further comprising means for sealingly attaching the bore at the bottom of the valve body to production casing through which the well production tubing extends into the well, and outlet means in the wall of the valve body in communication with the bore of the valve body for releasing any gas or fluid in the annulus between the inside of the casing and the outside of the production tubing.

8. The safety valve of claim 1 further comprising means for sealingly attaching the top of the valve body to the body of a production tree and wherein the packoff means within the bore of the valve body includes means for sealingly connecting the flow path of the packoff means with the flow path of the production tree.

9. The safety valve of claim 8 further comprising means for raising the packoff means within the bore of the valve body while the production tree is attached to the top of the valve body, and means for removing the ram gate means from the lateral hole in the valve body, whereby the punch out tube means may be replaced between the tubing hanger means and the packoff means without removing the production tree from attachment atop the valve body.

10. A safety valve for controlling the flow in a flow line comprising, a punch out tube separate of said flow line, means for securing said punch out tube in series with the flow line, and ram means for ramming the punch out tube, displacing at least a portion of the punch out tube from the flow path of the flow line, and sealing the flow line.

11. The valve of claim 10 wherein the flow line is a production tubing extending into a borehole and the means for securing a punch out tube in series with the production tubing comprises, a valve body having an axial bore and means for attaching the body to a wellhead at the surface of the borehole, a hanger supported within the bore of the valve body, the hanger supporting the production tubing in the borehole, a packoff ring sealingly engaging the axial bore of the body above the tubing hanger, the packoff ring having a bore therethrough axially aligned with the production tubing below supported by the hanger, and a cylindrical recess in the top of the tubing hanger and a cylindrical recess in the bottom of the packoff ring, said recesses adapted to secure the punch out tube.

12. The valve of claim 10 wherein the flow line is a production tubing extending into a borehole and the means for securing a punch out tube in series with the production tubing includes a body having an axial bore and means for securing the punch out tube in the axial bore in flow communication between the production tubing below and an upper outlet conduit, and the ram means for ramming the punch out tube comprises a lateral channel in the body having a ramming member aligned with the punch out tube and adapted to move in the lateral channel substantially perpendicularly to the axial bore for ramming the punch out tube, moving it away from the axial bore and sealing the upper outlet conduit from flow communication with the production tubing below.

13. The valve of claim 12 further comprising a chamber means disposed laterally opposite the lateral channel in the body for receiving at least a portion of the punch out tube after it is rammed by the ramming means.

14. A punch out tube adapted for placement in series with a flow line comprising, a bottom cylindrical member having a groove provided in its top end surface and extending around the circumference of the top end surface, a top cylindrical member having a groove provided in its bottom end surface and extending around the circumference of its bottom surface, a middle cylindrical member having a groove provided in its bottom end surface and a groove provided in its top end surface, said grooves in the bottom end surface and top end surface extending around the circumference of the top and bottom end surfaces, said top, bottom, and middle cylindrical members being stacked whereby the bottom end surface of the middle cylindrical member abuts the top end surface of the bottom cylindrical member and the bottom end surface of the top cylindrical member abuts the top end surface of the middle cylindrical member and the grooves in the abutting surfaces cooperate to form a circumferential channel in the abutting middle and top members and in the abutting bottom and middle members, and means disposed in the resulting channels between the bottom and middle members and between the middle and top members for sealing the members against flow through the tube resulting from the stacked members, whereby when the top and bottom members are fixed and the middle member is rammed from its side, the middle member is separated from the bottom and top members.

15. The punch out tube of claim 14 in which the cylindrical members are fabricated of metal and the means disposed in the resulting channels is vulcanized rubber bonded to the grooves in the end faces of the stacked members.

16. The punch out tube of claim 15 in which the means disposed in the resulting channels are "O" rings.

17. The punch out tube of claim 16 in which the "O" rings are fabricated from an elastomeric material.

18. The punch out tube of claim 16 in which the "O" rings are fabricated from a synthetic fluorine containing resin.

19. The punch out tube of claim 14 in which the cylindrical members are fabricated of a corrosion resistant material.

20. The punch out tube of claim 14 further comprising cylindrical recesses in the outer wall of the top and bottom members and sealing means placed in the recesses for sealing the punch out tube to surfaces on the ends of a flow line joined by the punch out tube.

21. A safety valve for controlling the flow in a flow line comprising, a punch out tube having, a bottom cylindrical member having a groove provided in its top end surface and extending around the circumference of the top end surface, a top cylindrical member having a groove provided in its bottom end surface and extending around the circumference of its bottom surface, a middle cylindrical member having a groove provided in its bottom end surface and a groove provided in its top end surface, said grooves in the bottom end surface and top end surface extending around the circumference of the top and bottom end surfaces, said top, bottom, and middle cylindrical members being stacked whereby the bottom end surface of the middle cylindrical member abuts the top end surface of the bottom cylindrical member and the bottom end surface of the top cylindrical member abuts the top end surface of the middle cylindrical member and the grooves in the abutting surfaces cooperate to form a circumferential channel in the abutting middle and top members and in the abutting bottom and middle members, and means disposed in the resulting channels between the bottom and middle members and between the middle and top members for sealing the members against flow through the tube resulting from the stacked members;

whereby when the top and bottom members are fixed and the middle member is rammed from its side, the middle member is separated from the bottom and top members, means for securing the punch out tube in series between first and second sections of the flow line, and ram means for ramming the middle member of said punch out tube, displacing the middle member from the flow path of the flow line and sealing the second section of the flow line from gas or fluid in the first section of the flow line.

22. The safety valve of claim 17 in which the cylindrical members are fabricated of metal and the means disposed in the resulting channels is vulcanized rubber bonded to the grooves in the end faces of the stacked members.

23. The safety valve of claim 21 wherein the flow line is a production tubing extending into a borehole and the means for securing a punch out tube in series with the production tubing comprises a valve body having an axial bore and means for attaching the body to a wellhead at the surface of the borehole, a hanger supported within the bore of the valve body, the hanger supporting the production tubing in the borehole, a packoff ring sealingly engaging the axial bore of the body above the tubing hanger, the packoff ring having a bore therethrough axially aligned with the production tubing below supported by the hanger, and a cylindrical recess in the top of the tubing hanger and a cylindrical recess in the bottom of the packoff ring, the recesses adapted to support the punch out tube.

24. The safety valve of claim 21 wherein the flow line is a production tubing extending into a borehole, and the means for securing a punch out tube in a series with the production tubing includes a body having an axial bore and means for securing the punch out tube in the axial bore in flow communication between the production tubing below and an upper outlet conduit, and the ram means for ramming the punch out tube comprises a lateral channel in the body having a ramming member aligned with the punch out tube and adapted to move in the lateral channel substantially perpendicularly to the axial bore for ramming the punch out tube, moving it away from the axial bore and sealing the upper outlet conduit from flow communication with the production tubing below.

25. The safety valve of claim 24 further comprising a chamber means disposed laterally oppositely the lateral channel in the body for receiving at least a portion of the punch out tube after it is rammed by the ramming means.

26. The safety valve of claim 23 further comprising cylindrical recesses in the outer wall of the top and bottom members and sealing means placed in the recesses for sealing the punch out tube to recesses in the top of the tubing hanger and in the bottom of the packoff ring.

27. A blowout preventer for controlling flow in a production tube of a well comprising, means for sealingly securing a punch out tube between ends of two sections of production tubing to provide a flow path through the sections of production tubing via the punch out tube, annular ring means for securing at least one of the two sections of production tubing, ram means carrying integral sealing means and being laterally disposed from the punch out tube, and drive means for forcing the ram means laterally against the side of the punch out tube whereby the ram means displaces at least a portion of the punch out tube from the flow path and prevents flow from through the production tubing in cooperation with the integral sealing means for sealing with the annular ring means.

28. The blowout preventer of claim 27 wherein the punch out tube comprises, a bottom cylindrical member having a groove provided in its top end surface and extending around the circumference of the top end surface, a top cylindrical member having a groove provided in its bottom end surface and extending around the circumference of its bottom surface, a middle cylindrical member having a groove provided in its bottom end surface and a groove provided in its top end surface, said grooves in the bottom end surface and top end surface extending around the circumference of the top and bottom end surfaces, said top, bottom, and middle cylindrical members being stacked whereby the bottom end surface of the middle cylindrical member abuts the top end surface of the bottom cylindrical member and the bottom end surface of the top cylindrical member abuts the top end surface of the middle cylindrical member and the grooves in the abutting surfaces cooperate to form a circumferential channel in the abutting middle and top members and in the abutting bottom and middle members, and means disposed in the resulting channels between the bottom and middle member and between the middle and top members for sealing the members against flow through the tube resulting from the stacked members, whereby when the top and bottom members are fixed and the middle member is rammed from its side, the middle member is separated from the bottom and top members.

29. A safety valve adapted for controlling flow in production tubing in a well comprising, a valve body having an axial bore therethrough, means within the axial bore of the body for supporting a hanging means for securing the production tubing, means within the axial bore of the body for supporting a packoff means within the body of the axial bore and disposed axially above the tubing hanger means, the packoff means having an axial flow path therethrough, punch out tube means disposed between the packoff means and the tubing hanger means, the bore of the punch out tube means being axially aligned with the well production tubing below and the flow path of the packoff means above, and ram gate means disposed in a lateral slot in the valve body and having a ramming member aligned with the wall of the punch out tube means for ramming the punch out tube means, moving a portion of it away from the flow path and sealing the flow path of the packoff means from communication with gas or fluid in the well production tubing, wherein the punch out tube means has a bottom cylindrical member having a groove provided in its top end surface and extending around the circumference of the top end surface, a top cylindrical member having a groove provided in its bottom end surface and extending around the circumference of its bottom surface, a middle cylindrical member having a groove provided in its bottom end surface and a groove provided in its top end surface, said grooves in the bottom end surface and top end surface extending around the circumference of the top and bottom end surfaces, said top, bottom, and middle cylindrical members being stacked whereby the bottom end surface of the middle cylindrical member abuts the top end surface of the bottom cylindrical member and the bottom end surface of the top cylindrical member abuts the top end surface of the middle cylindrical member and the grooves in the abutting surfaces cooperate to form a circumferential channel in the abutting middle and top members and in the abutting bottom and middle members, and means disposed in the resulting channels between the bottom and middle members and between the middle and top members for sealing the members against flow through the tube resulting from the stacked members, whereby when the top and bottom members are fixed and the middle member is rammed from its side, the middle member is separated from the bottom and top members.

30. A safety valve adapted for controlling flow in two production tubings in a well comprising a valve body having an axial bore therethrough, means within the axial bore of the body for supporting a hanging means for securing two well production tubings, means within the axial bore of the body for supporting packoff means within the axial bore of the body, the packoff means disposed axially above the tubing hanger means and having two bores therein, the bores of the packoff means being axially aligned with the two well production tubings supported below by the hanging means, first and second punch out tube means disposed between the packoff means and the tubing hanger means, the first punch out tube means being connected between one of the production tubings below and one of the bores of the packoff means above, the other punch out tube means being connected between the other of the production tubings below and the other of the bores of the packoff means above, and first and second gate means disposed laterally in the valve body, each gate means having a ramming member aligned with the wall of one of the punch out tube means for ramming one of the punch out tube means, displacing at least a portion of it from its original flow path, and sealing the bore of the respective packoff means from any gas or fluid in the well production tubings.

31. The valve of claim 30 in which the first and second punch out tubes are disposed side-by-side between the packoff means and the tubing hanger means, and the first and second gate means are disposed on opposite sides of the valve body, each punch out tube being aligned angularly with one of the gate means.

32. The valve of claim 30 further comprising sealing means on said ramming means for sealingly preventing flow from each production tubing after the respective gate means rams and displaces the punch out tube associated with the respective production tubing, whereby preventing flow communication from one tubing to the other.

33. A safety valve adapted for controlling flow in two production tubings in a well comprising, a valve body having an axial bore therethrough, means within the axial bore of the body for supporting a hanging means for securing two well production tubings in the well, means within the axial bore of the body for supporting a first packoff means within the axial bore of the body, the first packoff means disposed axially above the tubing hanger means and having two bores therein, the bores of the first packoff means being axially and angularly aligned with the two well production tubings supported below by the hanging means, and having a tubular extension of the first packoff means having a first means extending axially upward from the bottom of the first bore, first punch out tube means disposed between the first bore of the first packoff means and a first bore in the hanging means, the first bore in the hanging means being in flow communication with a first one of the production tubings, means within the second bore of the first packoff means for supporting a second tubing extension means, the second tubing extension means being in flow communication with the second of the production tubings and extending axially upward from the first punch out tube means, means within the axial bore of the body for supporting a second packoff means within the axial bore of the body, the second packoff means disposed axially above the second tubing extension means and having two bores therein, the bores of the second packoff means being axially and angularly aligned with the two well production tubings supported below by the hanging means, the first bore of the second packoff means provided about the top of the first tubular extension means, second punch out tube means disposed between the second bore of the second punch out means and the top of the second tubing extension means, and first and second gate means disposed in lateral slots in the valve body, each gate means having a ramming member aligned with the wall of one of the punch out tube means for ramming one of the punch out tube means, displacing at least a portion of it from its original flow path, and sealing the flow path of the respective packoff means from gas or fluid in the well production tubings.

34. The valve of claim 33 wherein the first and second gate means are disposed on the same side of the valve body, each punch out tube being aligned axially with one of the gate means.

35. The valve of claim 33 further comprising means for preventing flow between the first and second well production tubings after the first and second punch out tube means have been rammed and displaced by the respective ramming member.

36. In a well having production casing installed therein, a method of installing production tubing in the well in cooperation with a blowout preventer for controlling flow in the production tubing comprising the steps of attaching the body of the blowout preventer having a gate ram and actuator attached thereto to the production casing, running production tubing with a tubing hanger attached to the top thereof through the bore of the blowout preventer body until the tubing hanger lands on a landing shoulder in the bore of the body of the blowout preventer, running a punch out production tube sealingly connected to the upper packoff into the valve body and sealingly connecting the punch out production tube to the flow path of the tubing supported within the tubing hanger, axially aligning the hanger tubing hanger and the upper packoff to assure alignment of the punch out tube with the gate ram, and attaching a production tree to the top of the valve body.

37. In a production well having a blowout preventer valve attached between the production wellhead and the production tree, the blowout preventer having a valve body having an axial bore therethrough, means within the axial bore of the body for supporting a hanging means for securing well production tubing, means within the axial bore of the body for supporting a packoff means within the body of the axial bore and disposed axially above the tubing hanger means, the packoff means having an axial flow path therethrough, punch out tube means disposed between the packoff means and the tubing hanger means, the bore of the punch out tube means being axially aligned with the well production tubing below and the flow path of the packoff means above, and ram gate means disposed in a lateral slot in the valve body and having a ramming member aligned with the wall of the punch out tube means for ramming the punch out tube means displacing at least a portion of the punch out tube from the flow path and sealing the flow path of the packoff means from communication with gas or fluid in the well production tubing, means for sealingly attaching the top of the valve body to the body of a production tree and wherein the packoff means within the bore of the valve body includes means for sealingly connecting the flow path of the packoff means with the flow path of the production tree, means for raising the packoff means within the bore of the valve body while the production tree is attached to the top of the valve body, and means for removing the ram gate means from the lateral slot in the valve body, a method of replacing the punch out tube means between the tubing hanger means and the packoff means without removing the production tree from attachment atop the valve body comprising the steps of preventing flow in the production tubing below the tubing hanger, removing the ram gate means from the lateral slot in the valve body, raising the packoff means within the bore of the valve body, removing the previously used punch out tube means, securing a new punch out tube means in the axial flow path between the packoff means and the tubing hanger means, lowering the packoff means until the punch out tube is aligned with the lateral slot, and replacing the ram gate means in the lateral slot in the valve body.

* * * * *